US010702983B1

(12) United States Patent
Dietrich

(10) Patent No.: US 10,702,983 B1
(45) Date of Patent: Jul. 7, 2020

(54) WORK STAND SLIP COVER

(71) Applicant: Larry Dietrich, Jupiter, FL (US)

(72) Inventor: Larry Dietrich, Jupiter, FL (US)

( * ) Notice: Subject to any disclaimer, the term of this patent is extended or adjusted under 35 U.S.C. 154(b) by 0 days.

(21) Appl. No.: 15/909,238

(22) Filed: Mar. 1, 2018

(51) Int. Cl.
*A47H 1/10* (2006.01)
*B25H 1/00* (2006.01)
*D03D 1/04* (2006.01)

(52) U.S. Cl.
CPC ..... *B25H 1/0007* (2013.01); *D03D 1/04* (2013.01)

(58) Field of Classification Search
CPC ..... B25B 5/16
See application file for complete search history.

(56) References Cited

U.S. PATENT DOCUMENTS 392,746 A 11/1888 Noyes
2,771,939 A * 11/1956 Trubitt ..... A47C 31/11 297/225
4,105,220 A * 8/1978 Pacific ..... B62J 23/00 280/304.4
5,368,912 A 11/1994 Reaves
6,109,600 A 8/2000 Yost et al.
6,173,947 B1 1/2001 Johnson
8,034,424 B2 10/2011 Smith et al.
D661,937 S * 6/2012 Rice Golin ..... D6/611
9,427,849 B2 * 8/2016 McMillan ..... B25B 5/16
9,522,767 B1 12/2016 Pass
D817,034 S * 5/2018 Pittman ..... D6/611
2013/0220185 A1 8/2013 Valenta et al.
2017/0196370 A1 * 7/2017 Markowitz ..... B60N 2/60

* cited by examiner

*Primary Examiner* — Amy J. Sterling
(74) *Attorney, Agent, or Firm* — Ference & Associates LLC

(57) ABSTRACT

A slip cover for encapsulating a top portion of a work-stand is provided. The slip cover includes a D-shaped first portion and a D-shaped second portion. The D-shaped first portion and D-shaped second portion form a D-shaped slip cover with their three corresponding sides connected. The work stand includes a first stand, a second stand, and a foam sleeve. The first stand is coupled with the second stand. In one aspect, the first stand and second stand are adapted to tilt with respect to each other. The foam sleeve is applied on the top portion of the work-stand. The slip cover is applied over the top portion of the work-stand. Other aspects are disclosed and claimed.

4 Claims, 3 Drawing Sheets

WORK STAND SLIP COVER

BACKGROUND

Technical Field

The invention herein generally relates to work benches, and more particularly to work-stands for use in repairing and painting panels of automobile.

Description of the Related Art

Work-stands are generally used to hold panels of automobiles/vehicles to paint or to conduct any repair work. A top portion of the work-bench is formed by inverted U's cooperating to form a stable resting surface. Conventionally, foam rubber padding or other protective material may be applied to the top portion of the work-stand so that paint is not knocked or scratched off from freshly painted vehicle panels such as fenders or bumpers and the like. Over time, the foam rubber padding may become worn with grooves and pits capable of scratching the freshly painted vehicle panels.

Accordingly, there is a need to protect the freshly painted vehicle panels from having the paint scratched or bumped off or otherwise damaged by the worn foam rubber padding.

SUMMARY

In view of forgoing, an embodiment herein provides a slip cover for encapsulating a top portion of a work-stand. The slip cover comprises a D-shaped first portion and a D-shaped second portion. The D-shaped first portion and D-shaped second portion form a D-shaped slip cover by fastening three sides of the D-shaped first portion to the D-shaped second portion. The D-shaped slip cover is adapted to cover the top portion of a frame of the work-stand. The work stand comprises a first stand, a second stand, and a foam sleeve. The first stand is coupled with the second stand. In one embodiment, the first stand and second stand are adapted to tilt with respect to each other. The foam sleeve is applied on the top portion of the first stand and second stand. The slip cover is applied over the foam sleeve on the top portion of the work-stand. In another embodiment, the first stand and second stand are a tubular stand. In another embodiment, the first stand and second stand are inverted U-shaped stands. The slip cover is approximately 12 inches in height, approximately 42 inches in length and approximately 2 inches in width.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Conventionally, when repairing and re-painting body panels for vehicles, technicians may utilize portable work benches (also known as work stands). The work benches may be opened and closed by using scissoring support legs comprising inverted squared off U-shaped tubular steel frames and may hold up to 500-750 pounds. Such a work bench might be the Eastwood 750 Lb Work Stand manufactured by The Eastwood Company of Pottstown Pa.

The top portion of the bench may be formed by each of the inverted U's cooperating to form a stable resting surface. Typically, foam rubber padding or another protective material is applied to the top of the bench so that paint is not knocked or scratched off from freshly painted vehicle panels such as fenders or bumpers and the like. Over time, the foam rubber padding may become worn with grooves and pits capable of scratching the freshly painted vehicle panels. Additionally, the foam rubber padding may eventually split away and fall off the top of the work bench leaving the exposed metal surface of the work bench which will likewise scratch or knock off fresh paint.

By applying one (1) of the inventor's D-shaped work stand slip covers to each side of the top of the work stand such that the worn foam rubber padding is covered, the grooves and pits can no longer scratch or knock off paint from the painted vehicle panels rested on the work stand. Likewise, if the foam rubber padding has fallen off, the D-shaped work stand may be fitted directly over the exposed metal surface of the work stand. Moreover, a separate blanket that is ill-fitted for the purpose may be eliminated in favor of the inventor's D-shaped work stand slip cover. The inventor's D-shaped work stand slip cover described may be approximately 12 inches high, 42 inches long and 2 inches wide to accommodate various dimensions of a work stand. The D-shaped slip cover may be fabricated using various desirable materials and dimension.

Figure 1A:
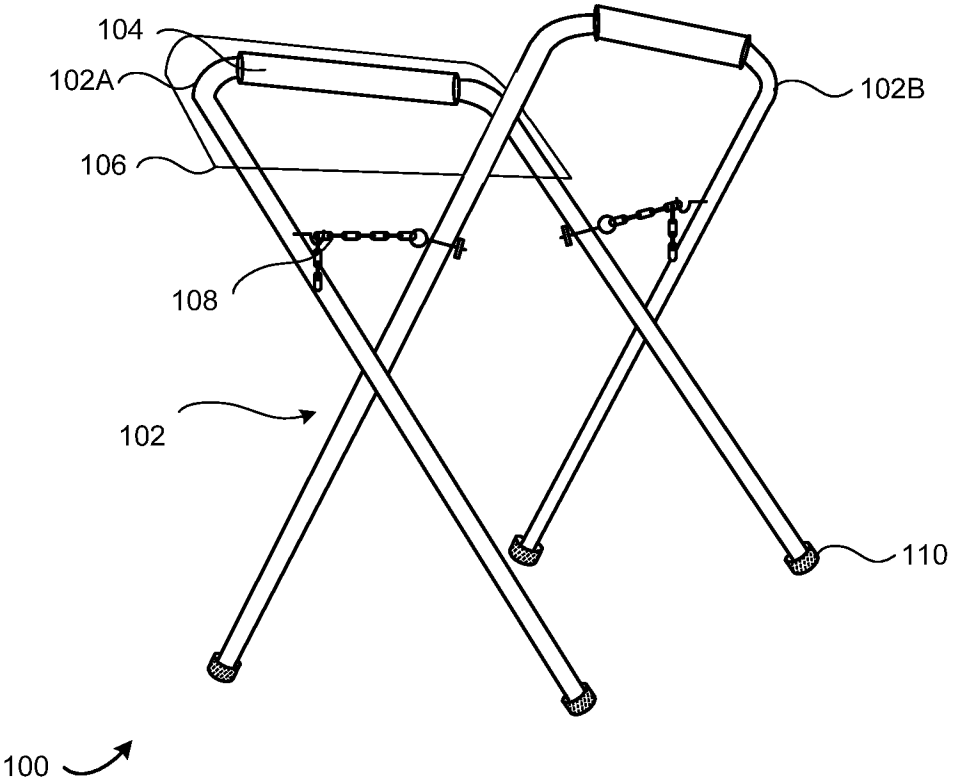
FIG. 1A illustrates a perspective view of an example work-stand according to an embodiment.
Figure 1B:
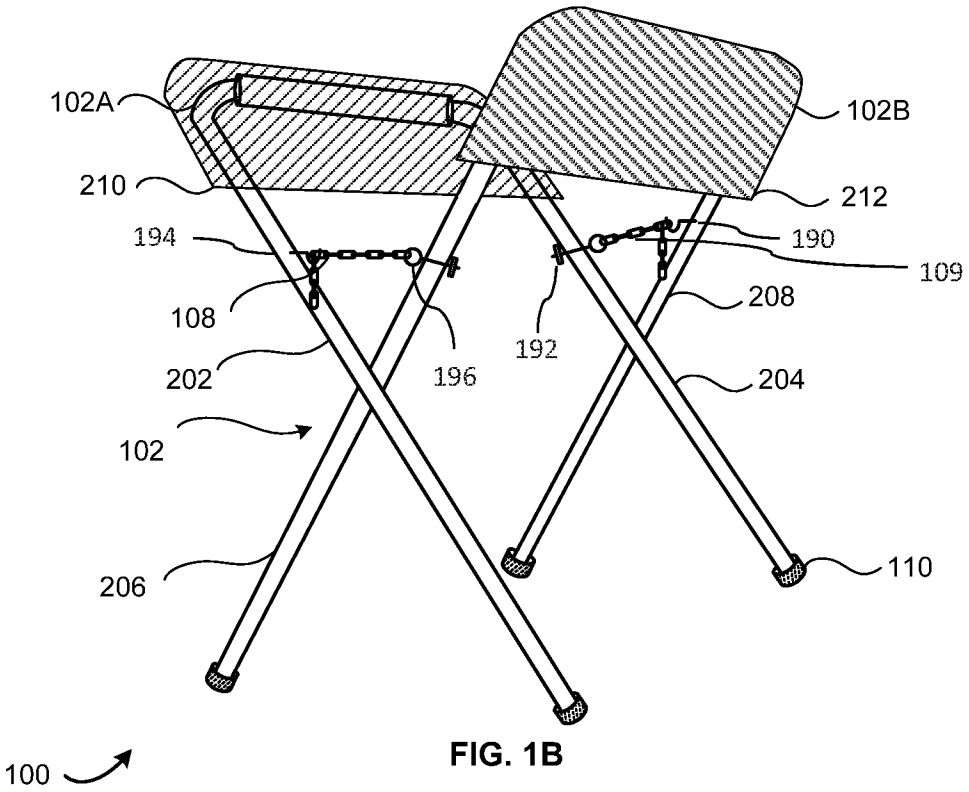
FIG. 1B illustrates a perspective view of an example work stand according to an embodiment.
Figure 2:
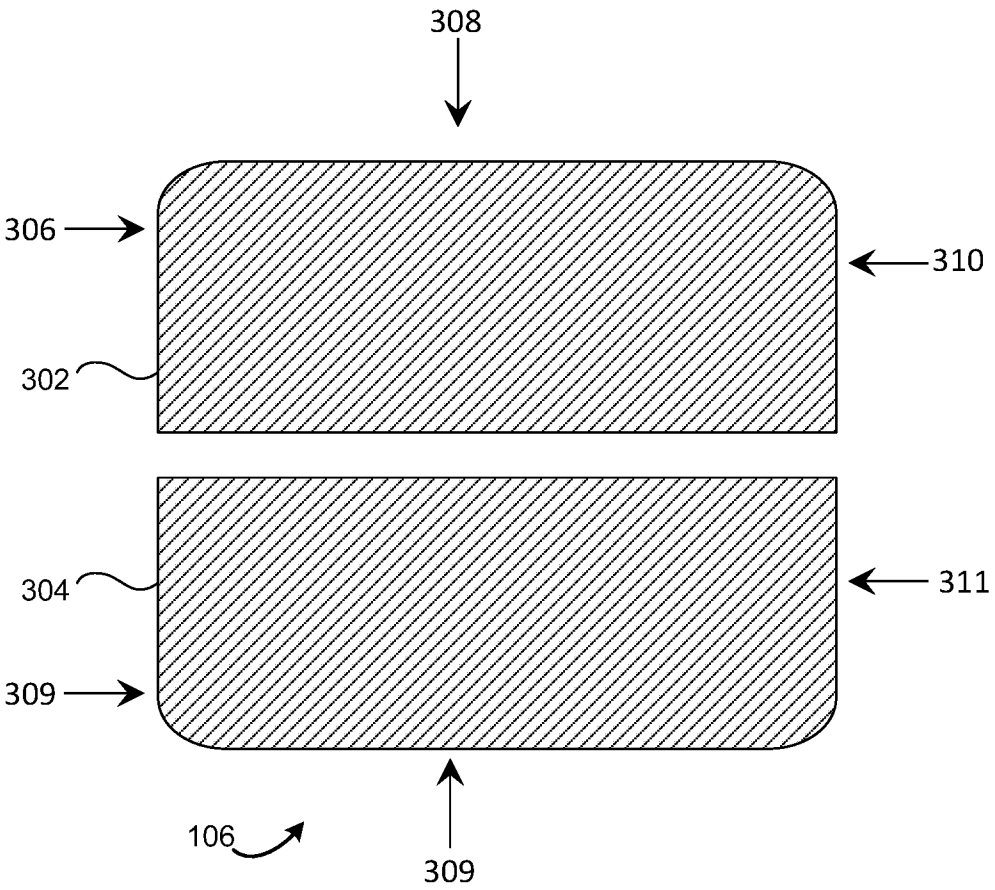
FIG. 2 illustrates a perspective view of an example slip cover according to an embodiment.

Referring now to the drawings and more particularly to FIGS. 1A through 1B and FIG. 2 where similar reference characters denote corresponding features consistently throughout the figures there are shown preferred embodiments.

FIGS. 1A-B illustrate a perspective view of an example work-stand 100 according to an embodiment. In one example, the work-stand 100 is referred to as to an encapsulated work-stand 100. The work-stand includes a frame

102, a foam sleeve 104, and a slip cover 106. The foam sleeve 104 is applied on a top portion of the frame 102. The slip cover 106 is adapted to cover the top portion of the frame 102. The frame 102 includes a first stand 102A and second stand 102B. In one embodiment, the first stand 102A is coupled with the second stand 102B that enables tilting or changing angle of the first stand 102A and the second stand 102B with respect to each other. In one embodiment, the first stand 102A includes a first left leg 202 and a first right leg 204. In another embodiment, the second stand 102B includes a second left leg 206 and a second left leg 208.

In one embodiment, the first stand 102A and second stand 102B are a tubular stand. In another embodiment, the first stand 102A and second stand 102B are inverted U-shaped stands. In one embodiment, a midpoint of the first left leg 202 is connected to a midpoint of the second left leg 206 by a connector, and a midpoint of the first right leg 204 is connected to a midpoint of the second right leg 208 by a connector. A first left hook eye connector 194 is disposed in the top one half of the first left leg 202. A second left hook eye connector 196 is disposed in the top half of the second left leg 206. A first right hook eye connector 192 is disposed in the top one half of the first right leg 204. A second right hook eye connector 190 is disposed in the top one half of the second right leg 208. The work stand 100 includes a pair of chains, left chain 108 and right chain 109, coupled to the first stand 102A and the second stand 102B. More specifically, a first end of the right chain 109 is connected to the first right hook eye connector 192 and a second end of the right chain 109 is connected to the second right hook eye connector 190. A first end of the left chain 108 is connected to the first left hook eye connector 194 and a second end of the left chain 108 is connected to the second left hook eye connector 196. In another embodiment, the pair of chains 108 and 109 enable tilting and locking of the first stand 102A with respect to the second stand 102B and vice versa. The distance between the first stand 102A and the second stand 102B is described by the length between the first end and second end of the left chain 108 or the length between the first end and second end of the right chain 109.

In one embodiment, the slip cover 106 is approximately 12 inches in height, approximately 42 inches in length and approximately 2 inches in width. In another embodiment, one slip cover 106 is adapted to cover the top portion of either the first stand 102A or the second stand 102B. In another embodiment, the slip cover 106 is a hollow cover that covers over the top portion of the frame 102. In another embodiment, the slip cover 106 may includes a first slip cover 210 that is applied on the first stand 102A and a second slip cover 212 that is applied on the second stand 102B. In one embodiment, legs of the frame 102 comprise non-skid tips 110. The slip cover 106 eliminates scratching or knocking off paint from painted vehicle panels rested on the work-stand 100. In another embodiment, the first stand 102A is coupled to the second stand 102B as a scissor structure. In another embodiment, the work-stand may be opened and closed by using scissoring support legs that may hold up to 500-750 pounds.

FIG. 2 illustrates a perspective view of an example slip cover 106 as shown in FIGS. 1A-B according to an embodiment herein. The slip cover 106 may comprise a D-shaped first portion 302 and a D-shaped second portion 304. The D-shaped first portion and D-shaped second portion form a D-shaped slip cover by fastening three sides (306, 308, and 310) of the first portion 302 with the three sides (307, 309, and 311) of the second portion 304. In other words, side 306 may be fastened to side 304, side 308 may be fastened to side 309, and side 310 may be fastened to side 311 such that except for the bottom side of the D-shaped first portion 302 and the D-shaped second portion 304 the slip cover is fastened together. In another embodiment, the D-shaped slip cover comprises a woven material or any other material having high durability.

An embodiment provides a slip cover for encapsulating a top portion of a work-stand wherein the slip cover comprises: a D-shaped first portion; and a D-shaped second portion, wherein by connecting three sides of the D-shaped first portion with the corresponding three sides of the D-shaped second portion, the D-shaped first portion and D-shaped second portion form a D-shaped slip cover, wherein the D-shaped slip cover is adapted to cover the top portion of a frame of the work-stand.

Optionally, the slip cover comprises a woven material or fabric.

Optionally, the slip cover comprises a hollow cover for accommodating the top of a work stand.

Optionally, three corresponding sides of the two D-shaped slip covers are fastened together and secured to the top of the work stand using stitches, zippers, hook and loop fasteners, buttons, or other fastening devices.

Optionally, the slip cover may comprise a disposable material, including but not limited to, paper or plastic or felt.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. An encapsulated work stand kit consisting of:

a tubular metal work stand, comprising:

a tubular metal frame, comprising:

a first inverted u-shaped stand that includes a first left leg and a first right leg;

a second inverted u-shaped stand that includes a second left leg and a second right leg;

wherein the first left leg is connected to the midpoint of the second left leg by a first connector intersecting their midpoints;

wherein the first right leg is connected to the midpoint of the second right leg by a second connector intersecting their midpoints;

wherein a first left hook eye connector is disposed in the top one half of the first left leg;

wherein a second left hook eye connector is disposed in the top one half of the second left leg;

wherein a first right hook eye connector is disposed in the top one half of the first right leg;

wherein a second right hook eye connector is disposed in the top one half of the second right leg;

wherein a first end of a right chain is connected to the first right hook eye connector;

wherein a second end of the right chain is connected to the second right hook eye connector;

wherein a first end of a left chain is connected to the first left hook eye connector;

wherein a second end of the left chain is connected to the second left hook eye connector;

wherein the first stand and second stand are adapted to tilt with respect to each other at a distance described by the length between the first end and second end of the left chain or the length between the first end and the second end of the right chain;

and a slip cover for encapsulating a top portion of a work-stand, wherein the slip cover comprises:

a D-shaped first portion; and a D-shaped second portion, wherein by connecting three sides of the D-shaped first portion with the corresponding three sides of the D-shaped second portion, the D-shaped first portion and D-shaped second portion form a D-shaped slip cover, wherein the D-shaped slip cover is adapted to cover the top portion of a frame of the work-stand.

2. The encapsulated work stand kit of claim 1, wherein the slip cover comprises a quilted woven material.

3. The encapsulated work stand kit of claim 1, wherein a foam sleeve is applied on the top portion of the frame and below the slip cover.

4. An encapsulated work stand kit consisting of:

a tubular metal work stand, comprising:

a tubular metal frame, consisting of:

a first inverted u-shaped stand that includes a first left leg and a first right leg;

a second inverted u-shaped stand that includes a second left leg and a second right leg;

wherein the first left leg is connected to the midpoint of the second left leg by a first connector intersecting their midpoints;

wherein the first right leg is connected to the midpoint of the second right leg by a second connector intersecting their midpoints;

wherein a first left hook eye connector is disposed in the top one half of the first left leg;

wherein a second left hook eye connector is disposed in the top one half of the second left leg;

wherein a first right hook eye connector is disposed in the top one half of the first right leg;

wherein a second right hook eye connector is disposed in the top one half of the second right leg;

wherein a first end of a right chain is connected to the first right hook eye connector;

wherein a second end of the right chain is connected to the second right hook eye connector;

wherein a first end of a left chain is connected to the first left hook eye connector;

wherein a second end of the left chain is connected to the second left hook eye connector;

wherein the first stand and second stand are adapted to tilt with respect to each other at a distance described by the length between the first end and the second end of the left chain or the length between the first end and the second end of the right chain; and a slip cover for encapsulating a top portion of a work-stand, wherein the slip cover comprises:

a D-shaped first portion; and a D-shaped second portion, wherein by connecting three sides of the D-shaped first portion with the corresponding three sides of the D-shaped second portion, the D-shaped first portion and D-shaped second portion form a D-shaped slip cover, wherein the D-shaped slip cover is adapted to cover the top portion of a frame of the work-stand.

* * * * *